US008051867B2

(12) United States Patent
Hamilton-Jones

(10) Patent No.: US 8,051,867 B2
(45) Date of Patent: Nov. 8, 2011

(54) GABLE CLOSURE SYSTEM FOR TENTS

(75) Inventor: Matthew H. Hamilton-Jones, Endicott, NY (US)

(73) Assignee: Johnson Outdoors Inc., Racine, WI (US)

( * ) Notice: Subject to any disclaimer, the term of this patent is extended or adjusted under 35 U.S.C. 154(b) by 53 days.

(21) Appl. No.: 12/608,182

(22) Filed: Oct. 29, 2009

(65) Prior Publication Data

US 2010/0108114 A1 May 6, 2010

Related U.S. Application Data

(60) Provisional application No. 61/109,971, filed on Oct. 31, 2008.

(51) Int. Cl.
*E04H 15/64* (2006.01)

(52) U.S. Cl. ..... 135/119; 135/115; 135/905; 52/222; 24/460

(58) Field of Classification Search ..... 135/97, 135/121, 115, 117, 119, 905; 52/222; 160/392, 160/351; 24/580.1, 453, 460–462
See application file for complete search history.

(56) References Cited

U.S. PATENT DOCUMENTS

| | | | | |
|---|---|---|---|---|
| 3,875,623 | A * | 4/1975 | Johnston | 24/580.1 |
| 4,878,322 | A * | 11/1989 | Ikeda et al. | 52/2.18 |
| 4,935,995 | A * | 6/1990 | Daus, Jr. | 24/580.1 |
| 5,732,755 | A * | 3/1998 | Cross | 160/57 |
| 6,247,484 | B1 * | 6/2001 | Thomas | 135/123 |
| 6,412,507 | B1 * | 7/2002 | Carter | 135/145 |
| 6,484,739 | B1 * | 11/2002 | Sofie et al. | 135/117 |
| 6,502,593 | B1 * | 1/2003 | Stafford | 135/115 |
| 6,564,513 | B2 * | 5/2003 | Henbid et al. | 52/86 |
| 6,860,069 | B2 * | 3/2005 | Morris | 52/2.22 |
| 2007/0062567 | A1 * | 3/2007 | Warner | 135/97 |
| 2007/0215192 | A1 * | 9/2007 | Hoffman | 135/135 |

FOREIGN PATENT DOCUMENTS

| | | | |
|---|---|---|---|
| DE | 3824142 | A1 * | 1/1990 |
| EP | 597094 | A1 * | 5/1994 |

* cited by examiner

*Primary Examiner* — Winnie Yip
(74) *Attorney, Agent, or Firm* — Reinhart Boerner Van Deuren P.C.

(57) ABSTRACT

A tent and method of assembling a tent is provided. The tent includes a connecting strip for connecting first and second panels of a fabric shell of the tent. The connecting strip slides axially along sides of the adjacent panels during assembly to connect them together. In a preferred embodiment, the connecting strip and sides of the connected panels utilize cooperating keder strips and keder channels to cooperatingly connect the two panels. In a preferred embodiment, the connecting strip is flexible to permit using connecting strips that are longer than the legs of the tent.

7 Claims, 4 Drawing Sheets

GABLE CLOSURE SYSTEM FOR TENTS

CROSS-REFERENCE TO RELATED PATENT APPLICATION

This patent application claims the benefit of U.S. Provisional patent application Ser. No. 61/109,971, filed Oct. 31, 2008, the entire teachings and disclosure of which are incorporated herein by reference thereto.

FIELD OF THE INVENTION

The present invention relates to tents and more particularly to devices and methods for assembling tents and fabric panels of tents.

BACKGROUND OF THE INVENTION

Tents can be very large and can be used for providing a shelter and environment for large gatherings and celebrations such as theatrical events, wedding receptions and conventions. For these large tents, a shell of the tent is typically supported by a frame. The frame typically includes structural members that combine to support the shell. Typically, the shell is formed from one or more fabric panels. The structural members may include vertical legs that define the walls of the tent and rafters that extend at an angle relative to the vertical legs toward a peak of the tent to define the roof. These peaked roofs include a gabled end.

In many large tents, the gabled portion of the end of the tents, i.e. the generally triangular portion of the end wall between the sides of the sloping roof, are typically formed by two generally right-triangular pieces of fabric that are secured in back to back relation. Typically, the two pieces are first coupled along their individual hypotenuses to the side of the roof and then secured to one another in the back-to-back relation.

One method to secure these two pieces in back-to-back relation was to use a zipper that secured the two abutting sides of the fabric panels to one another. Unfortunately, because the gabled portion of the end of the tent is above the legs of the tent, zipping these two panels together required assemblers to use a ladder to fully zip the abutting sides all the way to the peak of the gable. Not only does this increase danger in setting up the tent, but it makes setting up the tent more time consuming as well as requires assemblers to lug around a ladder.

The present invention provides an improved tent and an improved method of assembling a tent and particularly a tent having a gabled end.

BRIEF SUMMARY OF THE INVENTION

The present invention provides improved methods of connecting adjacent fabric panels of a tent that provides easer, quicker and safer assembly of a shell of a tent. Further, the invention provides a tent formed using such methods. More particularly, embodiments of the invention allow installers to get down from or stay away from the peak of the tent during assembly. Instead, installers are allowed to stay near or on the ground during assembly of portions of the tent which previously required an installer getting all the way to the peak.

In one form, the invention provides a method of assembling a tent including the steps of: supporting first and second fabric gable panels by a frame of a tent, and connecting the first and second gable panels to form a gable portion of the tent by connecting a first side of the first gable panel with a second side of a second gable panel with a connecting strip. By using a connecting strip, the user can remain on the ground or on a short ladder to connect the two panels rather than having to have access to a peak of the tent. Typically, the connecting strip will be a continuous structure that extends substantially the entire length of the first and second sides.

In a preferred form of the method, the step of connecting a first side of the first gable panel with a second side of a second gable panel includes first engaging only a portion of the first side with the connecting strip and then engaging a second equal portion of the second side with the connecting strip and then axially pushing the connecting strip simultaneously along both the first and second sides towards a peak of the tent.

In a further preferred form of the method, the connecting strip is flexible such that the method includes flexing the connecting strip out of a plane defined by the connected first and second fabric panels in the event that the connecting strip is longer than the distance from the bottom side of the fabric panels and the ground.

In another aspect, the invention provides a tent including a frame defined by a plurality of support members, and a fabric shell supported by the frame. The fabric shell includes first and second fabric panels. A first side of the first fabric panel being connected to a second side of the second panel by a connecting strip.

In a preferred embodiment of the tent of the present invention, the first and second sides of the fabric panels include keders and the connecting strip includes keder channels that engage the keders. This arrangement allows for easily sliding the connecting strip along the sides when assembling the tent.

Further yet, in an embodiment, the connecting strip is plastic and flexible, but sufficiently rigid to prevent buckling of the connecting strip while sliding it along the first and second sides of the two panels the connecting strip connects.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
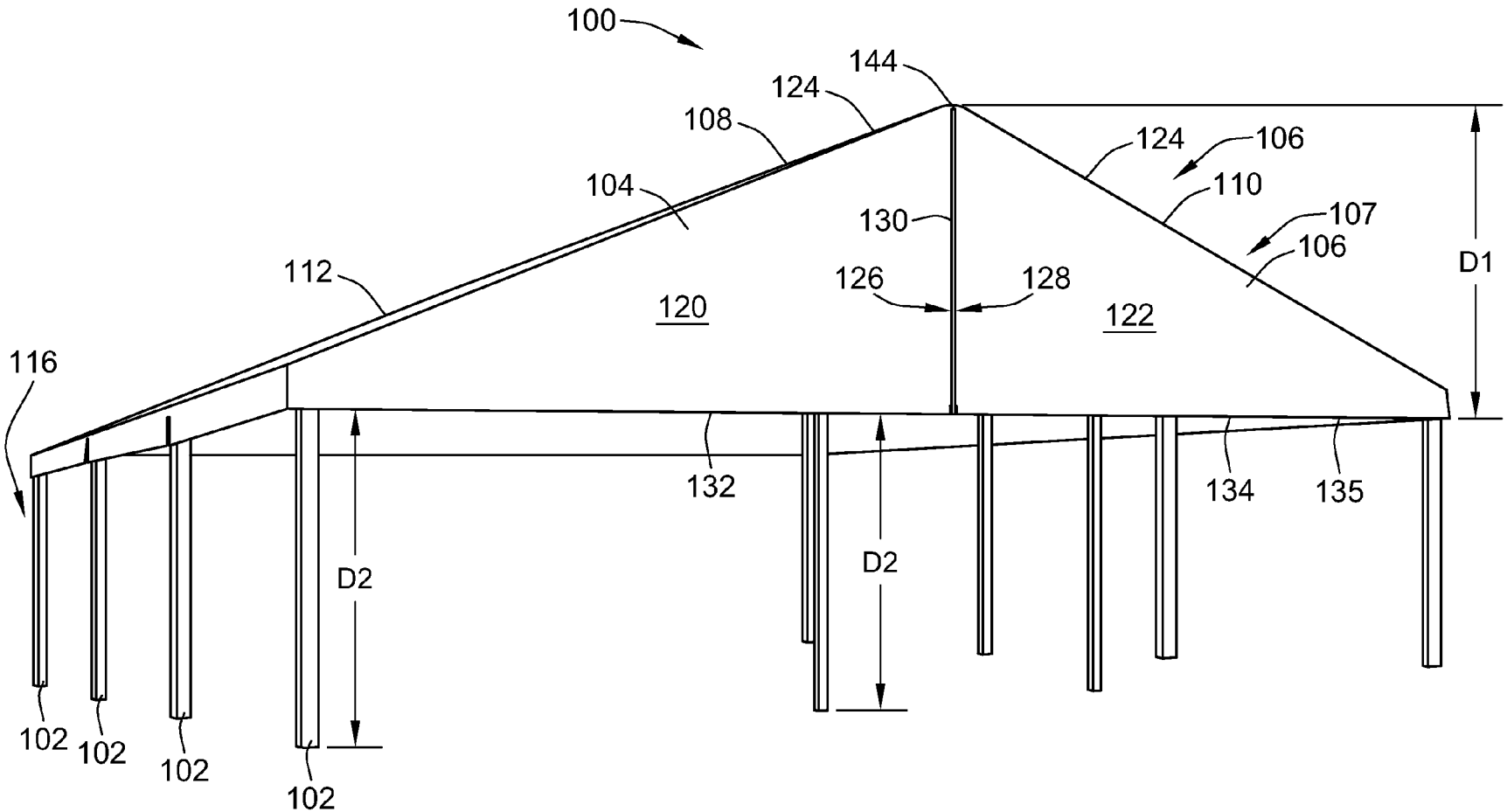
FIG. 1 is a perspective illustration of a tent assembled in accordance with the teachings of the present invention.

FIG. 1 illustrates an embodiment of a tent 100, which may also take the form of a canopy, according to the teachings of the present invention. The tent 100 includes a frame 102, formed from a plurality of support members, that supports a fabric shell 104. The frame defines the sides, ends and roof of the tent 100.

In the illustrated embodiment, the tent 100 includes a gabled end 106. The gabled end 106 includes a gable portion 107 that is formed between the two sloping sides 108, 110 of the roof 112 of the tent 100. The gabled portion 107 is generally triangular in shape and is generally located above, or slightly overlapping the top of, the tent sides 116.

Among other panels, the fabric shell 104 includes two gable panels 120, 122 arranged and connected to one another in back-to-back relation to enclose the gable portion 107. The gable panels 120, 122 of the illustrated embodiment are generally right triangular in shape and mirror images of one another.

The hypotenuse 124 of each gable panel 120, 122 is connected to the tent frame 102 at the roof sides 108, 110. Sides 126, 128 of the gable panels 120, 122 that abut one another in a back-to-back relation are secured together by an independent connecting strip 130 such that the two panels 120, 122 basically form a single panel. The connecting strip is not a load bearing member and is therefore not part of the frame nor is it a frame/support member. Sides 126, 128 extend vertically downward from the peak 144 of the roof of the tent 100. The connecting strip 130 acts as seam connecting the two gable panels 120, 122 together. Preferably, the remaining sides 132, 134 of the gable panels 120, 122 align horizontally forming a generally continuous bottom side 135 of the gable portion 107.

Figure 2:
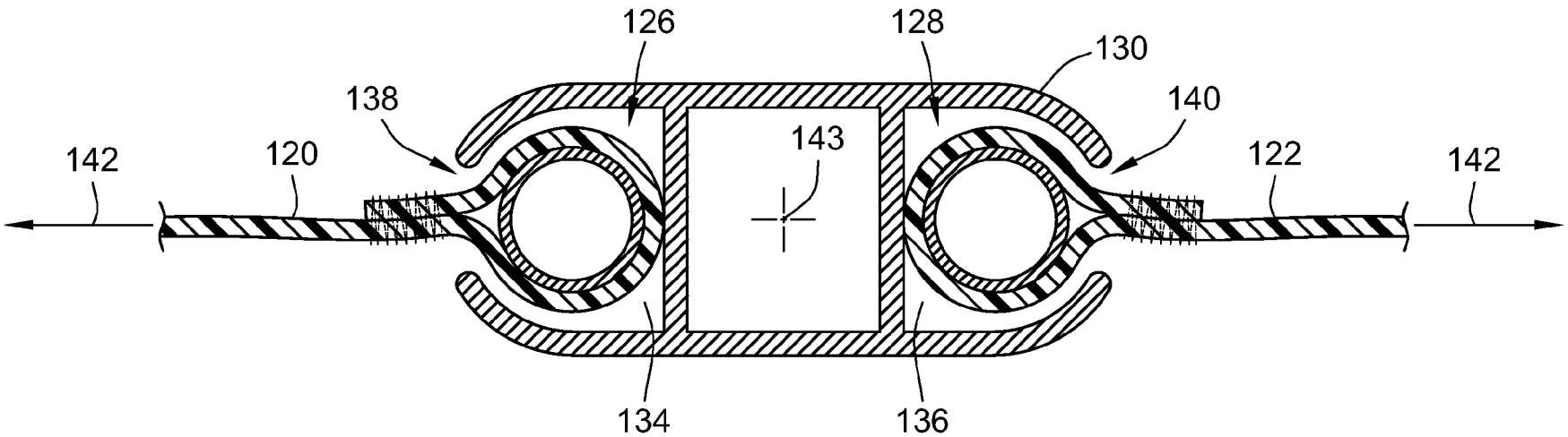
FIG. 2 is a schematic cross-sectional illustration of a connection between two gable panels of a tent according to the teachings of the present invention.

As illustrated in FIG. 2, sides 126, 128 are formed by keders to facilitate simple and easy engagement with connection strip 130 which is in the form of a keder rail. More particularly, sides 126, 128 are received in channels 134, 136, respectively, of the connection strip 130. The channels 134, 136 have narrowed mouths 138, 140 that prevent the keders (sides 126, 128) from being laterally pulled from channels 134, 136 under tensile loading, such as illustrated by arrows 142 that is perpendicular to central axis 143 of the connection strip 130.

Referring to FIG. 1, to assemble the gable portion 107 of tent 100, the user will first support gable panels 120, 122 from the frame 102 such that the gable panels 120, 122 are hanging vertically from the frame. Typically, this is either done by having the gable panels 120, 122 formed as part of the fabric panels that form the roof of the tent 100. Alternatively, the hypotenuse side 124 of the fabric panels 120, 122 is secured to the support members forming the side of the sloped roof. Preferably, sides 124 of gable panels 120, 122 of the roof include keders and the structural members forming the side of the roof include cooperating keder channels to secure the gable panels 120, 122 to the structural members forming the sloped side of the roof.

Figure 3:
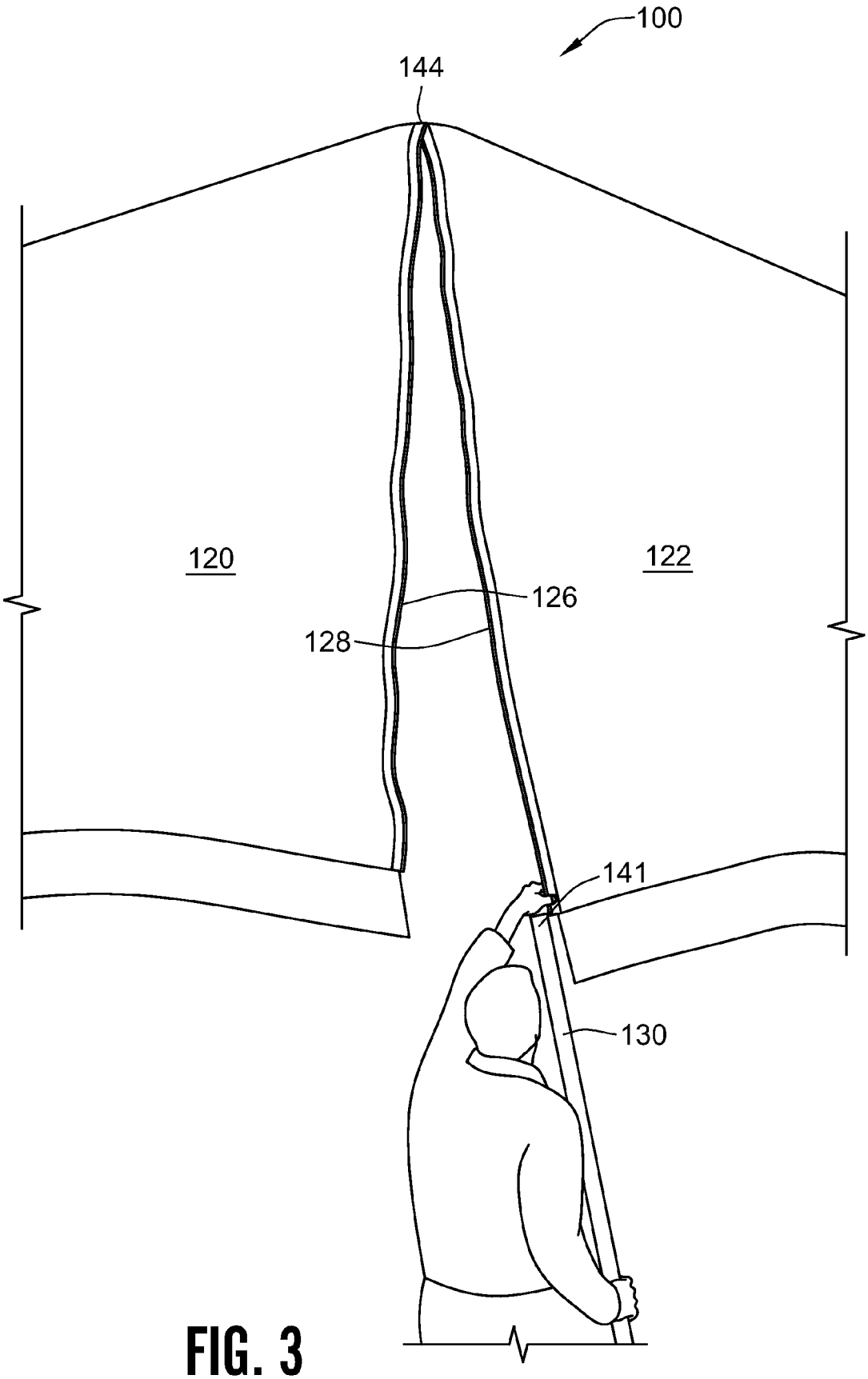
FIGS. 3 and 4 are illustrations showing steps in assembling the gabled portion of the tent of FIG. 1 according to a method of the present invention.
Figure 4:
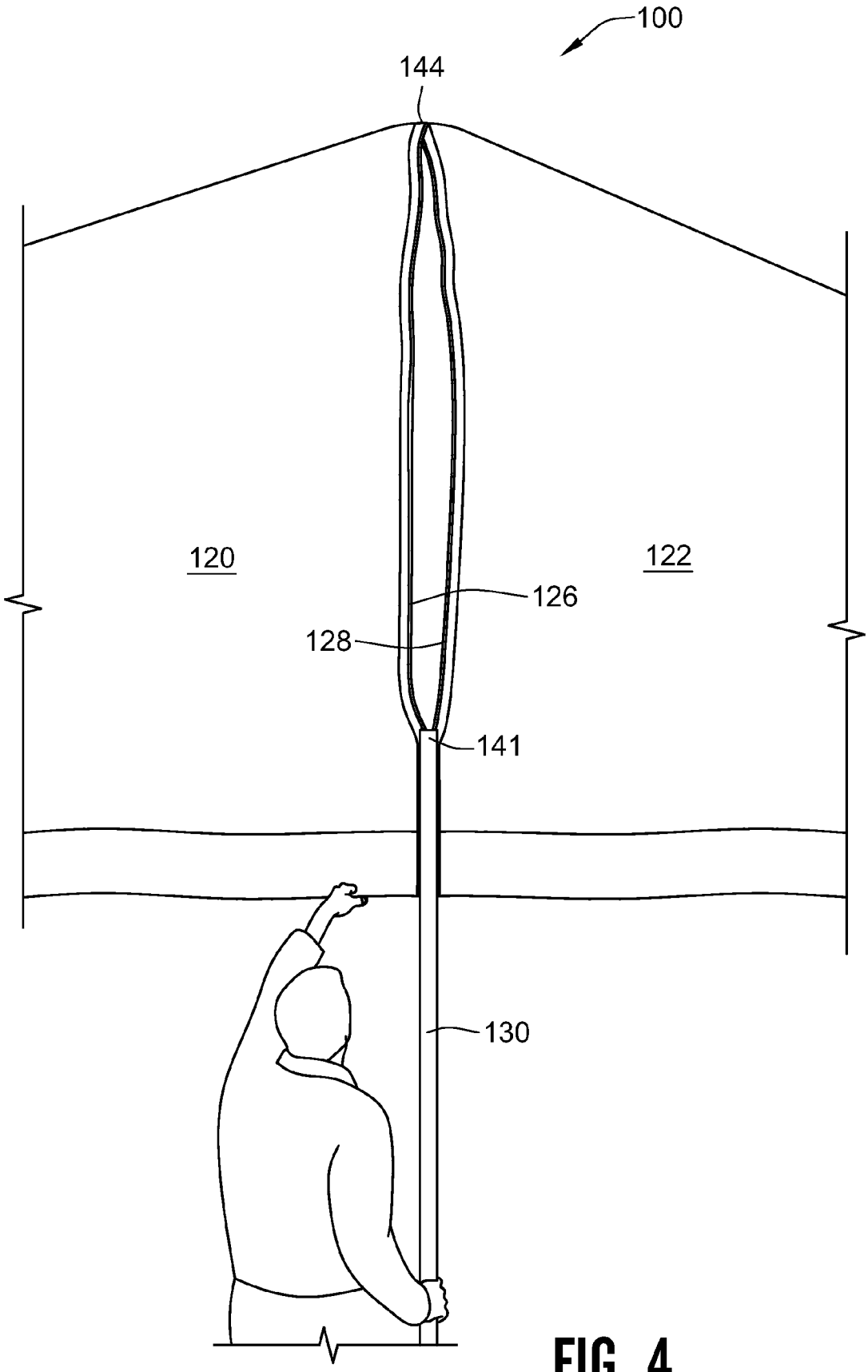

With the gable panels 120, 122 hanging vertically, a first one of sides 126, 128 is engaged by end 141 of connecting strip 130 (See FIGS. 3, 4). More particularly, as illustrated in FIG. 3, the keder of the first one of sides 126, 128 is inserted into the corresponding channel 134, 136 of the connecting strip 130. The first one of sides 126, 128 is axially inserted into the corresponding channel 134, 136 only a short distance. Typically, the first one of sides 126, 128 is axially inserted into the corresponding channel 134, 136 only between about 1 inch and 10 inches.

With reference to FIG. 4, the other one of the sides 126, 128 is engaged by the connecting strip 130. More particularly, the keder of the other one of sides 126, 128 is inserted into the corresponding channel 134, 136 of the connecting strip 130. At this point, it is desirable to get both sides 126, 128 equally engaged a same distance along axis 143 (see FIG. 2). In other words, the same amount of both side 126, 128 is received in their corresponding channel 134, 136. This will facilitate the next step.

With both of the two sides 126, 128 equally engaged by the connecting strip 130, the connecting strip 130 can be axially pushed towards peak 144 of the roof until end 141 reaches peak 144. During this step, the connecting strip 130 is preferably pushed along sides 126, 128 equally and simultaneously. Unlike structural members, the connecting strip 130 moves relative to the structural members of the frame during assembly and the fabric panels 120, 122 remain substantially stationary (i.e. little movement and flexing is permitted) while the user manipulates the position of the connecting strip 130 towards peak 144. FIG. 1 illustrates the connecting strip 130 in the final position. Once the connecting strip 130 is fully installed, the bottom side 135 is completed by further coupling the two panels 120, 122 using a buckle.

In a preferred embodiment, the connecting strip 130 is formed of flexible plastic because such an arrangement provides a significant advantage over rigid connecting strips, such as formed of metal. More particularly, because the distance D1 from the peak 144 to bottom side 135 of the gable portion 107 is often greater than the distance D2 between side 135 and the ground upon which the tent 100 is erected, the connecting strip 130 often must be bent out of the plane of the gabled end to initially engage the connecting strip with sides 126, 128. In other words, D1 is typically greater than the length of the legs of the sidewalls of tent 100 such that the connecting strip 130 would not otherwise be able to be connected to the ends of sides 126, 128.

In those instances where D1 is greater than D2, it can be impossible to use a rigid connecting strip 130 to connect panels 120, 122. As illustrated in FIG. 1, when fully assembled, panels 120, 122 are stretched tight, thus, during assembly, there is little if any slack or flexure in the panels 120, 122 to permit tipping or tilting of connecting strip 130 when engaging the second one of panels 120, 122 with the connecting strip 130. Thus, if a rigid connecting strip is used that is greater than D2 in length, the assembler must start from the peak 144 of the tent 100 and push the connecting strip toward side 135 and the ground. As indicated previously, requiring a user to reach up to and have access to the peak 144 of the tent 100 during assembly is highly undesirable. Further, holding an entire connecting strip up in the air above peak 144 can be very difficult to balance reducing installer stability and increasing the likelihood of falling off the ladder or the peak of the tent. The present invention directly relates to getting installers off of or down from the peak of the tent.

Thus, in one form of a method of assembling a gable portion 107 of a tent according to the teachings of the present invention, the method includes resiliently flexing the connecting strip 130 so as to be able to engage both panels 120, 122. More particularly, connecting strip 130 is bent out of a plane generally defined by the gabled end of the tent.

While the connecting strip 130 is preferably sufficiently flexible to be flexed out of a plane defined by the gable panels 120, 122, the connecting strip 130 needs to be sufficiently rigid to permit pushing the connecting strip along the sides 126, 128 during assembly without buckling. This rigidity must take into account increasing friction generated by increased engagement between the connecting strip 130 and sides 126, 128 as the connecting strip 130 is pushed along the first and second sides 126, 128.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of assembling a tent including the steps of:

supporting a fabric shell including first and second fabric gable panels by a frame of a tent; and connecting the first and second gable panels to form a gable portion of the tent by connecting a first side of the first gable panel with a second side of the second gable panel with a connecting strip, wherein the connecting strip is a keder rail having opposite keder channels and the first and second sides of the first and second gable panels are keders received in the opposite keder channels respectively, and the gable portion has a bottom side that is substantially horizontal, the bottom side being located a first distance above the ground, the gable portion having a peak located at a second distance from the bottom side, the first distance being less than the second distance, the gable portion defining a plane that is substantially vertical;

the step of connecting the first and second gable panels occurring while the first and second fabric panels are supported by the frame of the tent;

the step of connecting the first and second gable panels forms a seam therebetween provided by the connecting strip, the seam extending vertically downward from a peak of the tent;

the step of connecting the first and second gable panels includes flexing the connecting strip out of the substantially vertical plane defined by the gable portion to allow initially engaging the connecting strip with the first and second sides of the gable panel proximate the bottom side of the gable portion; and the step of connecting includes axially pushing the connecting strip along both the first and second sides vertically upward relative to gravity in a direction extend towards the peak of the tent from the bottom side of the gable portion to engage the first and second sides with the connecting strip to form the seam and the gable panel.

2. The method of claim 1, wherein the connecting strip is independent from the first and second gable panels.

3. A tent comprising:

a frame defined by a plurality of support members;

a fabric shell supported by the frame, the fabric shell including first and second fabric panels, a first side of the first fabric panel being connected to a second side of the second fabric panel;

the first and second fabric panels are triangular portions defining a vertical gabled end portion of the shell, the gabled end portion having a bottom side that is substantially horizontal, the bottom side being located a first distance above the ground, the gabled end portion having a peak located at a second distance from the bottom side, the first distance being less than the second distance, the gabled end portion defining a plane that is substantial vertical; and a connecting strip connecting the first and second sides to form a seam therebetween, the connecting strip extending vertically below the peak and interposed between the peak and the bottom side, the connecting strip having a length that is greater than the first distance;

the connecting strip is a keder rail having opposed keder channels and the first and second sides are keders received in the keder channels; and the connecting strip being sufficiently flexible to be flexed out of the vertical plane defined by the gabled end portion to allow initially engaging the connecting strip with the first and second sides proximate the bottom side of the gabled end portion but the connecting strip is sufficiently rigid to permit pushing the connecting strip vertically upwards along the first and second sides from the bottom side towards the peak while the first and second fabric panels are supported by the frame without buckling due to increasing friction generated by increased engagement between the connecting strip and the first and second sides as the connecting strip is pushed along the first and second sides towards the peak during assembly.

4. The tent of claim 3, wherein the first and second fabric panels are secured to corresponding support members of the frame forming sides of a roof of the tent, the first and second fabric panels being connected to the support members.

5. The tent of claim 3, wherein the connecting strip is plastic and has a length that is greater than a length of support members defining sides of the tent.

6. The tent of claim 3, wherein the connecting strip is plastic.

7. The tent of claim 6, wherein the connecting strip is not a structural member of the frame but merely a connector for securing the first and second fabric panels.

* * * * *